US007121210B2

(12) United States Patent
Steele

(10) Patent No.: US 7,121,210 B2
(45) Date of Patent: Oct. 17, 2006

(54) ACCURACY FUZE FOR AIRBURST CARGO DELIVERY PROJECTILES

(75) Inventor: Michael F. Steele, Cincinnati, OH (US)

(73) Assignee: KDI Precision Products, Inc., Cincinnati, OH (US)

( * ) Notice: Subject to any disclaimer, the term of this patent is extended or adjusted under 35 U.S.C. 154(b) by 0 days.

(21) Appl. No.: 10/368,112

(22) Filed: Feb. 18, 2003

(65) Prior Publication Data

US 2004/0159261 A1 Aug. 19, 2004

(51) Int. Cl.
*F42C 13/04* (2006.01)

(52) U.S. Cl. ..... 102/211; 102/477

(58) Field of Classification Search ..... 102/211, 102/214, 489, 477
See application file for complete search history.

(56) References Cited

U.S. PATENT DOCUMENTS

| | | | | |
|---|---|---|---|---|
| 4,159,476 | A | 6/1979 | Kohler | |
| 4,424,745 | A | 1/1984 | Magorian et al. | |
| 4,962,706 | A | 10/1990 | Ivermee et al. | |
| 5,317,975 | A | 6/1994 | Sauvestre et al. | |
| 5,325,784 | A * | 7/1994 | Bai et al. | 102/293 |
| 5,685,504 | A | 11/1997 | Schneider et al. | |
| 5,816,531 | A | 10/1998 | Hollis et al. | |
| 5,886,287 | A | 3/1999 | Will et al. | |
| 6,020,854 | A | 2/2000 | Jagnow et al. | |
| 6,069,584 | A | 5/2000 | Johnson | |
| 6,098,547 | A * | 8/2000 | West | 102/214 |
| 6,272,995 | B1 | 8/2001 | Schmidt et al. | |
| 6,307,514 | B1 * | 10/2001 | West | 343/705 |
| 6,345,784 | B1 * | 2/2002 | Shnaps | 244/3.15 |
| 6,389,974 | B1 * | 5/2002 | Foster | 102/211 |
| 6,474,592 | B1 * | 11/2002 | Shnaps | 244/3.15 |

* cited by examiner

*Primary Examiner*—Michael J. Carone
*Assistant Examiner*—Susan C. Alimenti
(74) *Attorney, Agent, or Firm*—Harness, Dickey & Pierce, PLC

(57) ABSTRACT

In one aspect, an artillery projectile apparatus is provided that includes a carrier projectile containing a payload, and a fuze disposed at an ogive of the projectile and which is configured to eject the payload when the fuze is detonated. The fuze includes a receiver configured to receive location information from a radionavigation source and a processor configured to acquire position data from the receiver. The processor is also configured to estimate a projectile flight path using the position data, to determine intercept parameters of the artillery projectile relative to an ejection plane of its payload cargo, and to adjust an ejection event initiation command time of the payload in accordance with the determined intercept parameters. In some configurations, the present invention dramatically decreases range errors typically associated with delivering artillery payloads to specific targets.

17 Claims, 4 Drawing Sheets

ACCURACY FUZE FOR AIRBURST CARGO DELIVERY PROJECTILES

FIELD OF THE INVENTION

The present invention relates to a low cost munition fuze having increased accuracy, and more particularly to a low cost munition fuze having reduced projectile launch and flight errors.

BACKGROUND OF THE INVENTION

Studies performed on the long-range accuracy of the current U.S. Army artillery shell stockpile have suggested that at ranges above 20 kilometers, numerous rounds must be fired to achieve a lethal effect on the target. Area saturation can be used to defeat or immobilize a target, at the costs of delaying advancing troops from reaching the target and allowing an enemy some opportunity to evade an assault. Additionally, conventional munition inaccuracies require friendly fire target standoff distances of greater than 600 meters, which prevents suppressive fire in support of target engagement by advancing troops for as much as 20 minutes.

Precision weapons are being developed to increase range, to significantly reduce the conventional munition logistic task and to resolve the battle engagement time and mobility issues. However, precision weapons are expensive, and their high accuracy may not be required for conventional munition ranges.

SUMMARY OF THE INVENTION

Some configurations of the present invention therefore provide an artillery projectile apparatus that includes a carrier projectile containing a payload, and a fuze disposed at an ogive of the projectile and which is configured to eject the payload when the fuze is detonated. The fuze includes a receiver configured to receive location information from a radionavigation source and a processor configured to acquire position data from the receiver. The processor is also configured to estimate a projectile flight path using the position data, to determine intercept parameters of the artillery projectile relative to an ejection plane, and to adjust an ejection event initiation command time of the payload in accordance with the determined intercept parameters.

Various configurations of the present invention also provide a method for delivering an artillery projectile payload to a target. The method includes determining a cargo ejection plane between a gun firing the artillery projectile and the target and a nominal ejection event initiation command time to deliver the artillery projectile payload to the target; firing the artillery projectile at the target; acquiring, at the artillery projectile after firing, position and time data; and adjusting, at the artillery projectile after firing, ejection event initiation command time of the artillery projectile payload in accordance with the acquired position and time data.

Some configurations of the present invention also provide a fuze that includes a fuze housing; fuze electronics including a processor and a radionavigation receiver contained within the fuze housing; and a power supply configured to power the processor and the radionavigation receiver; an explosive charge responsive to the processor. The processor is responsive to the radionavigation receiver to adjust a time at which the explosive charge is detonated.

It will be observed that configurations of the present invention provide a more accurate alternative to conventional munitions systems and a less expensive alternative to precision munitions systems. In some configurations, the present invention contains the artillery fuze functions, is profile-interchangeable with NATO requirements as defined in MIL-Std-333B, and/or incorporates technologically available smart munition updates.

Furthermore, it will be observed that some configurations of the present invention provide low cost, mid-range accuracy improvements that can reduce the number of deployed projectiles needed to acquire a target. Some configurations also provide additional cover fire protection to advancing troops by reducing standoff distances and times owing to improved munition accuracies.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
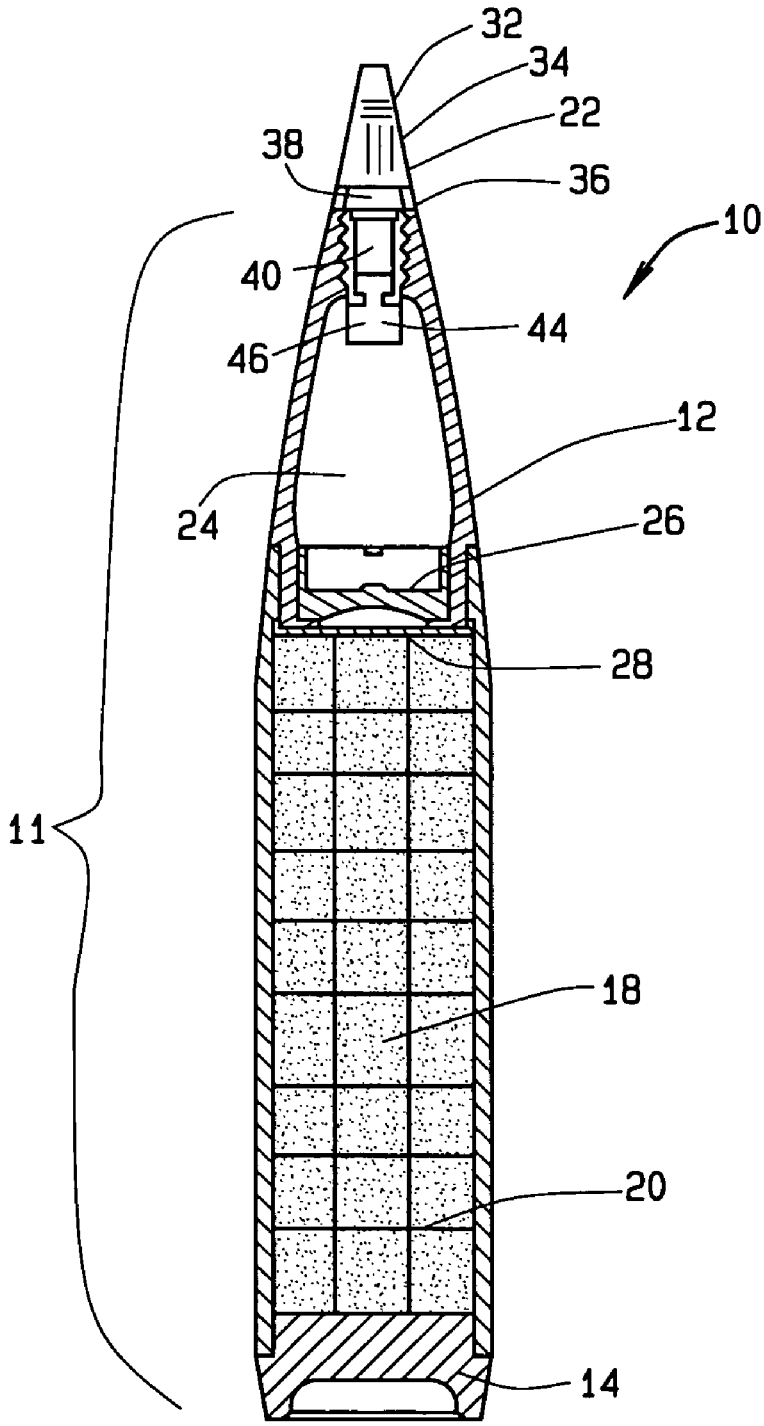
FIG. 1 is a cross-sectional drawing representative of various configurations of an artillery projectile of the present invention.

In some configurations and referring to FIG. 1, the present invention comprises an artillery projectile 10 that comprises a conventional carrier projectile 11 having a front head part or ogive 12 and a rear base part 14. Carrier projectile 11 contains one or more payloads such as grenades 18 that are configured to detonate on a target. A fuze 22 is disposed at ogive 12 and is configured to eject the payload when fuze 22 is detonated. In particular, when fuze 22 is detonated, an expanding gas fills a cavity 24 and forces piston 26 to press plate 28 rearward, forcing payload or payloads 18 to push against base 14. Base 14 is thus forced off carrier projectile 11 and payload or payloads 18 are ejected from projectile 11. Payload(s) 18 are spin-deployed to control payload dispersion during delivery. The operation and construction of piston 26, plate 28, payload 18 and base 14 are conventional and need not be described further.

Figure 2:
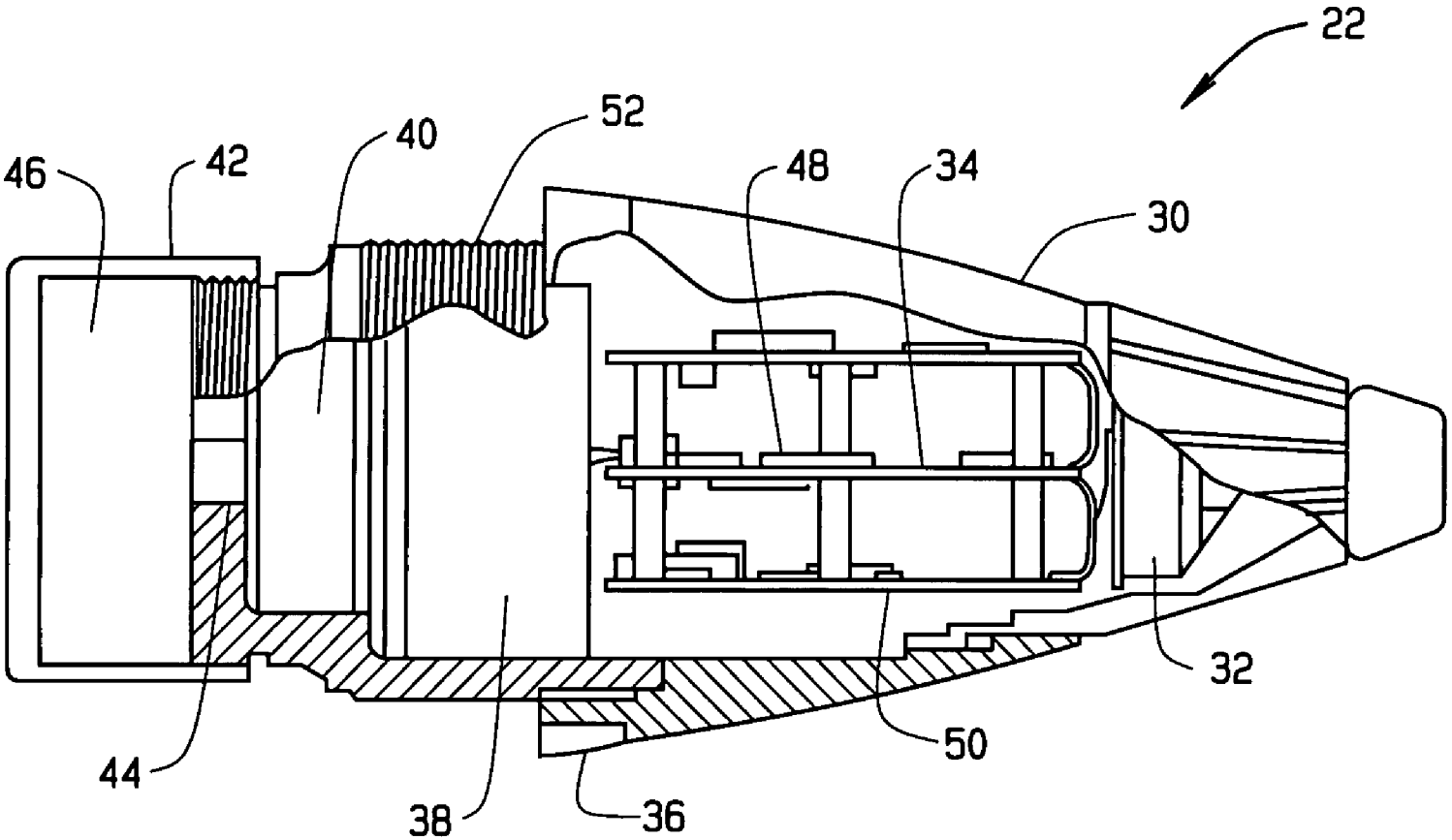
FIG. 2 is a partial cross-sectional drawing representative of various configurations of a fuze of the present invention, including a fuze configuration suitable for use in configurations of the artillery projectile represented in FIG. 1.

Referring to FIG. 2, fuze 22 comprises an outer casing 30, a fuze setter coil 32, circuit cards 34, a power supply assembly including a battery 38, a safe and arm assembly 40, and a booster cup 42. A lead charge 44 is configured to detonate booster pellets 46 in booster cup 42 in response to an ejection command from a processor 48 residing on circuit cards 34. For safety, the ejection command is preceded by two sensed launch commands in addition to an adjusted firing time command from the processor. Fuze 22 in some configurations is interface-equivalent with MIL-Std-333B specifications. Fuze 22 has screw threads 52 for attachment at ogive 12 of projectile 11.

In some configurations, a global positioning satellite (GPS) receiver 50 is provided in fuze 22 to reduce range errors. Receiver 50 utilizes a ring antenna 36 encircling fuze 22 to receive signals from GPS satellites (not shown). In another embodiment, another GPS-receptive antenna suitable for use with a high-spin-rate projectile could be used. Received GPS data from receiver 50 and time are used by processor 48 to determine a flight trajectory and to adjust payload ejection event initiation command timing for increased range accuracy, for example, by reducing the effects of temperature, gun lay, launch, firing charge, base-burner and projectile flight range errors. In some configurations, to avoid loss of a projectile, processor 48 defaults to a basic M762 fuze mode with fixed ejection times in the event of a GPS subsystem anomaly, such as jamming, inability to acquire satellite transmissions, etc.

Figure 3:
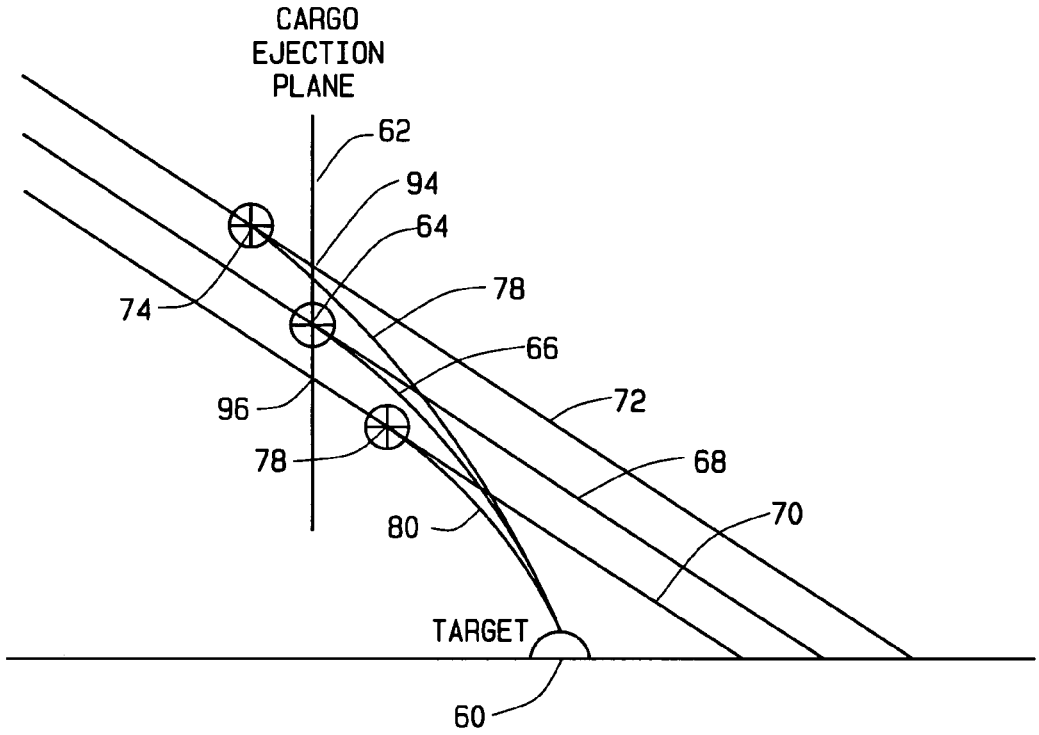
FIG. 3 is a drawing showing the relationship of various trajectories and ejection points relative to a nominal cargo ejection plane and a target, where the trajectories intercept the nominal cargo ejection plane at different heights.

Under normal conditions, GPS data will be available, and onboard processor 48 will use time data and the acquired GPS position data to calculate a projectile flight path, and to predict an intercept angle, height and time at which artillery projectile 10 will pass through a gun and target-defined ejection plane 62, as represented in FIG. 3. Downrange distance traveled by the payload 18 from an ejection point is a function of the height or elevation of the ejection point. A difference between an actual intercept point and a nominal intercept point 64 of a nominal projectile flight path 68 is determined and utilized to adjust an ejection event initiation command time for ejecting cargo payload (e.g., grenade or other dispensable munitions 18). For example, if artillery projectile 10 is more energetic than nominal, it would follow a flight path such as flight path 72. In this case, the ejection event initiation command time is adjusted so that ejection occurs at a point 74 prior to interception of cargo ejection plane 62 and payload 18 follows path 78, rather than path 66, to target 60. If the projectile is less energetic than nominal, the ejection event initiation command time is adjusted to eject payload 18 at a point 76 after interception of flight path 70 of artillery projectile 10, and payload 18 follows path 80 to target 60. These timing adjustments thus effect a more accurate delivery of payload 18 to target 60.

In some configurations, a secondary range adjustment is made by correcting the ejection event initiation command time of payload 18 in accordance with the trajectory slope. More particularly, and referring to FIG. 4, if the actual trajectory slope 84 is steeper and the forward or downrange velocity of the cargo at ejection is less than would be the case with a nominal trajectory slope 68, ejection event initiation command time is delayed so that payload 18 will impact target 60 by ejecting payload 18 at ejection point 86 and payload 18 follows descent path 92. On the other hand, if the actual trajectory slope 82 is flatter than nominal trajectory slope 68, the payload will be traveling downrange faster after release than if the payload were following nominal slope 68. Therefore, the ejection event initiation command time is advanced so that ejection of payload 18 occurs at a point 88 before trajectory slope 82 intersects cargo ejection plane 62. Payload 18 thus follows a path 90 that allows the payload to travel farther downrange after ejection, and yet still hit at or near target 60.

Figure 5:
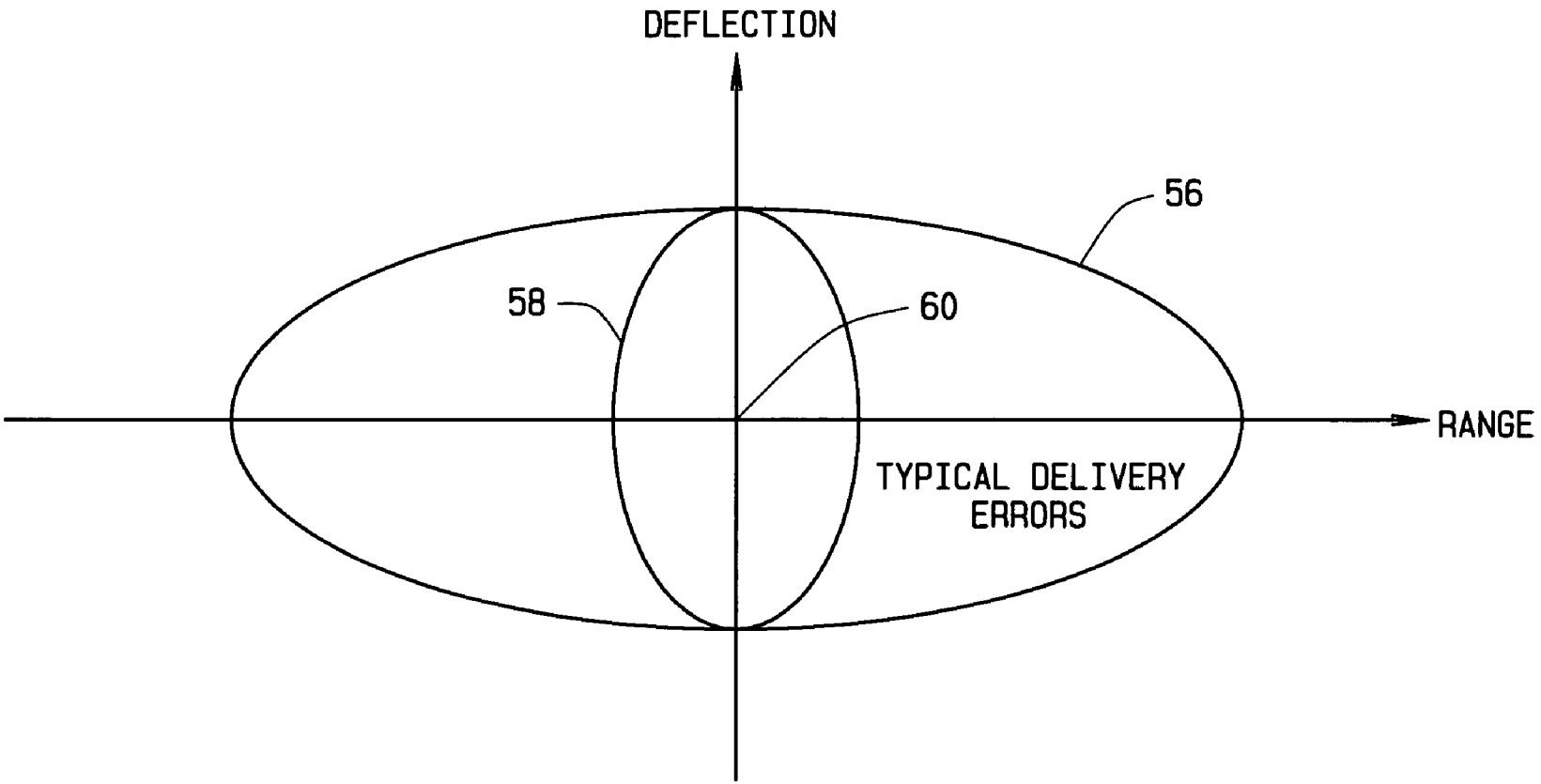
FIG. 5 is a drawing indicating the increased payload delivery accuracy achievable by various configurations of the present invention.

Referring to FIG. 5, by providing a fuze with a first order, or low cost one-dimensional range correction, a footprint representing typical delivery errors to a target 60 is reduced from a footprint 56 representing typical delivery errors in the absence of correction to a reduced size footprint 58 representing the delivery errors of a plurality of artillery projectile configurations and delivery method configurations of the present invention. Configurations of the present invention can be utilized in conjunction with techniques for reducing deflection errors to effect a two-dimensional correction and thus provide additional accuracy.

In some configurations of the present invention, power consumption is reduced by increasing the interval between GPS data samples. The sampling intervals can pre-selected in accordance with desired accuracy and power consumption levels, or may be varied during flight in some configurations to obtain a satisfactory trade-off between accuracy and power consumption. Estimated projectile flight parameters may be utilized to adjust GPS sampling intervals. For example, some 60-second projectile flights may require between 6 to 10 samples to adequately estimate the ejection time and trajectory intercept, although the number of samples required may vary from flight to flight.

Some configurations of the present invention utilize the following steps to hit a target with artillery projectile 10. First, using spatial position finding devices, both the target and the artillery projectile firing gun are located in three-dimensional space. The fuze power on sequence is then initiated. GPS gun and target location data and basic fuze initialization data is input to the fuze using the fuze setter. A typical configuration would accommodate turn-on, system initialization, and data entry and/or update within twenty minutes of the projectile firing.

An onboard processor 48 establishes, using target location data inputs, a cargo ejection plane 62 that is perpendicular to an azimuth range line between the gun and target 60. Cargo ejection plane 62 is located up range from target 60 by a distance determined to cause the deployed cargo grenades 18 to land on the target when cargo grenades 18 are dispensed from a nominal flight performance projectile 68. For example, in some configurations, a nominal projectile flight path 68 intercepts cargo ejection plane 62 at a nominal flight path to ejection plane intercept angle estimated at 52 degrees and at an estimated nominal height of burst altitude of 500 m. Initially, processor 48 is programmed to utilize data from GPS receiver 50 of fuze 22 to eject payload 18 when projectile 10 Intercepts ejection plane 62. In some configurations, the initialized intercept time is the same as the basic M762 set time, and further the processor 48 is configured to use the initialized intercept time as a default ejection event initiation command time in the event of a GPS anomaly or a fuze processing anomaly, thereby avoiding loss of the projectile.

After the fuze is programmed with target and gun location data, the artillery projectile 10 is loaded and fired. During flight, GPS receiver 50 acquires position and time data. Processor 48 is configured to use acquired GPS data to determine a deviation for a nominal projectile flight path to predict an intercept angle, height and time at which projectile 10 will pass through ejection plane 62. As the flight of projectile 10 continues, ejection plane intercept parameters are updated with each new GPS data set. A convergence test, for example, can be performed following each new set of intercept information to determine if a GPS anomaly has occurred. A detected GPS anomaly causes processor 48 to default to either the last predicted set of ejection plane intercept parameters or to a typical conventional fuze set time. Processor 48 is configured to use either the last predicted ejection plane parameters or a typical conventional fuze set time, dependent upon the number of successful GPS updates before an anomaly occurs, in the event such an anomaly occurs prior to ejection.

In some configurations, the intercept point of projectile 10 with ejection plane 62 can be predicted to an altitude of plus or minus 12 m and a range of plus or minus 8 m. Once the ejection plane intercept point is determined, a difference between the nominal impact point and a predicted impact point is used to enhance accuracy by adjusting the ejection event initiation command time. For example, if the predicted ejection plane 62 intercept point and time and nominal impact point 64 and time are coincident then no correction to the ejection event initiation command time is made and a nominal grenade decent trajectory 66 is used for the payload or grenades 18 to impact target 60. However, if artillery projectile 10 has higher velocity than a nominal artillery projectile, the predicted cargo ejection plane 62 intercept point 94 will be higher than nominal cargo ejection intercept point 64. Based on an elevation difference between cargo ejection intercept points 64 and 94 and a difference between times corresponding to points 64 and 94, the ejection event initiation command time is reduced, thus moving the ejection point up range to a point 74 and thereby adjusting payload 18 impact point to more closely coincide with target 60. Similarly, if artillery projectile 10 has lower velocity than a nominal artillery projectile, the ejection event initiation command time is increased so that the payload or grenades 18 are ejected at point 76 rather than at point 96, thereby adjusting descending grenade 18 to impact the ground at a point closely coinciding with target 60.

Figure 4:
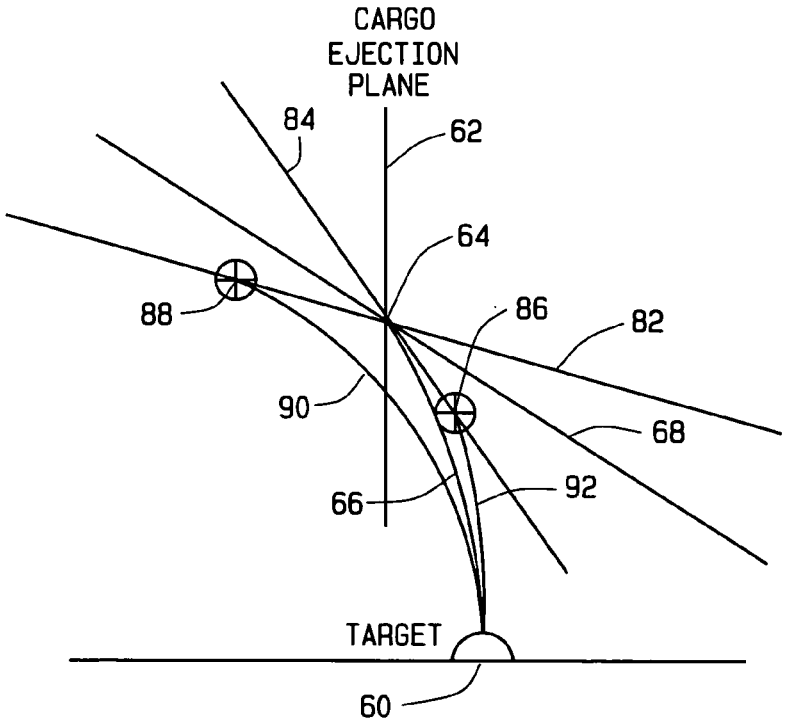
FIG. 4 is a drawing showing the relationship of various trajectories and ejection points relative to a nominal cargo ejection plane and a target, where the trajectories intercept the nominal cargo ejection plane at different angles.

In some configurations, and referring to FIG. 4, a secondary range error adjustment is made by correcting the payload ejection event initiation command time for the artillery projectile trajectory intercept angle and time with cargo ejection plane 62. In this case, if projectile intercept trajectory 84 is steeper than nominal intercept trajectory 68, the cargo ejection event initiation command time, i.e. the intercept trajectory 84 time, is delayed to allow payload 18 to fly further down range before ejecting its payload at a point 86. This adjustment allows the grenades to impact the ground at the target range. Similarly, if projectile flight trajectory 82 is flatter than nominal intercept trajectory 68, the timing is advanced to eject the payload or grenades 18 at point 88, prior to interception of ejection plane 62 by trajectory 82.

In some configurations, the fuze 22 design may meet some or all of the following specifications:

NATO Fuze Configuration, Mil-Std-333B

Mil-Std-1316D with overhead safety (Arm 50-msec. prior to Cargo Ejection)

M762S&A

Inductive set only with EPIAS (No hand set or adjustment)

20 minute ground set capability (No 10 day preset)

XM982 GPS jamming protection

M762 timing is default mode

Flight time 100 sec.

Accuracy 125 m circular error probability (CEP) at 35 km with 2 hr. met. Data

No decrease in lethal area

Gun harden—20,000 g setback

Gun harden—20,000 rpm spin 20 year shelf life

In some configurations, the profile of fuze 22 is identical to the M762 profile and satisfies the NATO requirements as defined in Mil-Std-333B. The front end of fuze 22 incorporates the same plastic ogive and fuze setter coil 32 that is used on some conventional configurations of M762 fuzes. The base of fuze 22 also retains the basic M762 design. Booster cap 42 includes explosives 46, and lead charge 44. Safe and arm assembly and piston actuator 40 prevents arming until artillery projectile 10 is within 50 msec. from payload 18 ejection.

Unlike conventional M762 fuzes, GPS receiver 50 with ring antenna 36 may be provided on circuit boards 34 in fuze 22 and processor 48 may be configured to take advantage of the information received by receiver 50. In some configurations, a battery 38 is provided to power fuze electronics, including GPS receiver 50 and processor 48.

Some configurations of fuze 22 utilize three double-sided circuit boards 34, which provide 16 square inches of component mounting surface. GPS receiver 50 and trajectory analysis processor 48 require approximately 10 square inches of circuit board area. Addition fuze electronics on circuit boards 34 utilize the GPS receiver clock and therefore the safety functions and firing circuits can be accommodated on 3 additional square inches of circuit board. Thus, up to three square inches can be provided for additional circuitry and functionality, if required.

Battery 38 can provide power for driving GPS receiver 50, processor 34 and additional fuze circuitry for 20 minutes of ground time followed a 2-second power initialization spike and then a constant power drain for a 100-second flight period. A battery with a volumetric configuration of 1.5 inches in diameter by 0.88 inches high has sufficient capacity in some configurations, although other battery configurations may also be used, depending upon cost and performance requirements.

The center section of the configurations of fuze 22 represented by FIG. 2 feature axial conformal circuit boards 34 mounted in front of battery 38. The battery can be, for example, a right circular cylinder positioned between safe and arm assembly 40 and circuit boards 34. Other configurations feature forward or aft mounting locations for battery 38. Some configurations provide stacked round circuit cards 34 instead of the conformal axial circuit boards 34 shown in FIG. 2. A battery 38 and circuit card 34 configuration can be selected in accordance with dynamic environment survival vs. assembly ease and component costs requirements.

It will be thus observed that configurations of the present invention provide a more accurate alternative to conventional munitions systems and a less expensive alternative to precision munitions systems. The above-described fuze provides improved accuracy without depleting the spin of a deployed cargo. Because deployment spin is conserved, a historical footprint of the cargo can be preserved. Also, some configurations are profile-interchangeable with the M762 fuze per MIL-Std-333B specifications and some configurations incorporate technologically available smart munition updates.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. An artillery projectile apparatus comprising:

a carrier projectile containing a payload; and a fuze disposed at an ogive of the projectile that is configured to eject the payload when the fuze is detonated, said fuze including a receiver configured to receive location information from a radionavigation source, said fuze also having a processor configured to acquire position data from the receiver, to estimate a projectile flight path using the position data, and to determine intercept parameters of the artillery projectile relative to an ejection plane, and to adjust an ejection event initiation command time of the payload in accordance with the determined intercept parameters.

2. An apparatus in accordance with claim 1 wherein said receiver is a GPS (global positioning satellite) receiver.

3. An apparatus in accordance with claim 2 wherein said GPS receiver has a variable sampling interval.

4. An apparatus in accordance with claim 3 wherein said GPS receiver is configured to vary its sampling interval during a flight of said apparatus.

5. An apparatus in accordance with claim 2 wherein said receiver is coupled to a ring antenna encircling the artillery projectile.

6. An apparatus in accordance with claim 2 wherein said processor is configured to update said ejection plane intercept parameters following acquisition of a GPS data set.

7. An apparatus in accordance with claim 6 further configured to perform convergence tests on said updated ejection plane intercept parameters following acquisition of a GPS data set.

8. An apparatus in accordance with claim 7 further comprising a timer, and further configured to utilize a default ejection timing based upon said timer in the event said convergence tests indicate a GPS anomaly.

9. An apparatus in accordance with claim 6 further configured to determine a projectile trajectory intercept angle with the ejection plane, and to adjust ejection event initiation command time in accordance with the determined projectile trajectory intercept angle.

10. An apparatus in accordance with claim 9 further configured to delay projectile ejection event initiation command time when the determined projectile trajectory intercept angle is steeper than a predetermined nominal trajectory, and to reduce projectile ejection event initiation command time when the projectile trajectory intercept angle is flatter than the predetermined nominal trajectory.

11. An apparatus in accordance with claim 1 further comprising axial conformal circuit boards mounted in front of a battery.

12. An apparatus in accordance with claim 11 wherein said battery is positioned between a safe and arm assembly and the conformal circuit boards.

13. An artillery projectile apparatus comprising:

a carrier projectile containing a payload; and a fuze disposed at an ogive of the projectile that is configured to eject the payload when the fuze is detonated, said fuze including a receiver configured to receive location information from a radionavigation source, said fuze also having a processor configured to acquire position data from the receiver, to estimate a projectile flight path using the position data, and to determine intercept parameters of the artillery projectile relative to an ejection plane, and to adjust an ejection event initiation command time of the payload in accordance with the determined intercept parameters; said fuze further comprising:

a fuze housing;

fuze electronics including a processor and a radionavigation receiver contained within said fuze housing;

a power supply configured to power the processor and the radionavigation receiver;

an explosive charge responsive to said processor; and said processor responsive to said radionavigation receiver to adjust a precise time from within said processor at which said explosive charge is detonated.

14. A fuze in accordance with claim 13 further comprising a ring antenna around the fuze housing and electronically coupled to the radionavigation receiver.

15. A fuze in accordance with claim 13 wherein said fuze electronics are mounted on axial conformal circuit boards.

16. A fuze in accordance with claim 13 wherein said radionavigation receiver has a variable sample rate for determining position data.

17. A fuze in accordance with claim 16 further configured to adjust the sample rate during a flight of the fuze.

* * * * *